United States Patent [19]

Cronert

[11] 4,004,633

[45] Jan. 25, 1977

[54] BRICK CONSTRUCTION FOR HORIZONTAL REGENERATOR

[75] Inventor: Wolfgang Cronert, Eikamp, Germany

[73] Assignee: Martin & Pagenstecher GmbH, Cologne, Germany

[22] Filed: Dec. 9, 1974

[21] Appl. No.: 531,024

[30] Foreign Application Priority Data

Dec. 13, 1973 Germany ..... 441153[U]

[52] U.S. Cl. ..... 165/9.1; 165/9.4

[51] Int. Cl.[2] ..... F28D 17/00

[58] Field of Search ..... 165/9.1–9.4

[56] References Cited

UNITED STATES PATENTS

| | | | |
|---|---|---|---|
| 1,167,081 | 1/1916 | Kennedy | 165/9.1 |
| 1,703,793 | 2/1929 | Stein | 165/9.4 |
| 2,473,427 | 6/1949 | Hasche | 165/9.4 |
| 2,823,027 | 2/1958 | Coberly | 165/9.4 |
| 3,630,503 | 12/1971 | Byrd, Jr. | 165/9.4 |

*Primary Examiner*—Albert W. Davis, Jr.
*Attorney, Agent, or Firm*—Burgess, Dinklage & Sprung

[57] ABSTRACT

An improvement in a horizontally disposed regenerator having a plurality of generally parallel courses of bricks separated by vertical spacers, each course of which runs generally horizontal, the improvement lying in that the bricks have a generally slab-like horizontal surface, and the vertical risers run generally longitudinal of said slab-like surfaces between courses of brick, the slab-like surface engaging the slab-like surface of an adjoining horizontally disposed brick, the vertical spaces engaging the slab-like surfaces by a tongue and groove connection.

11 Claims, 11 Drawing Figures

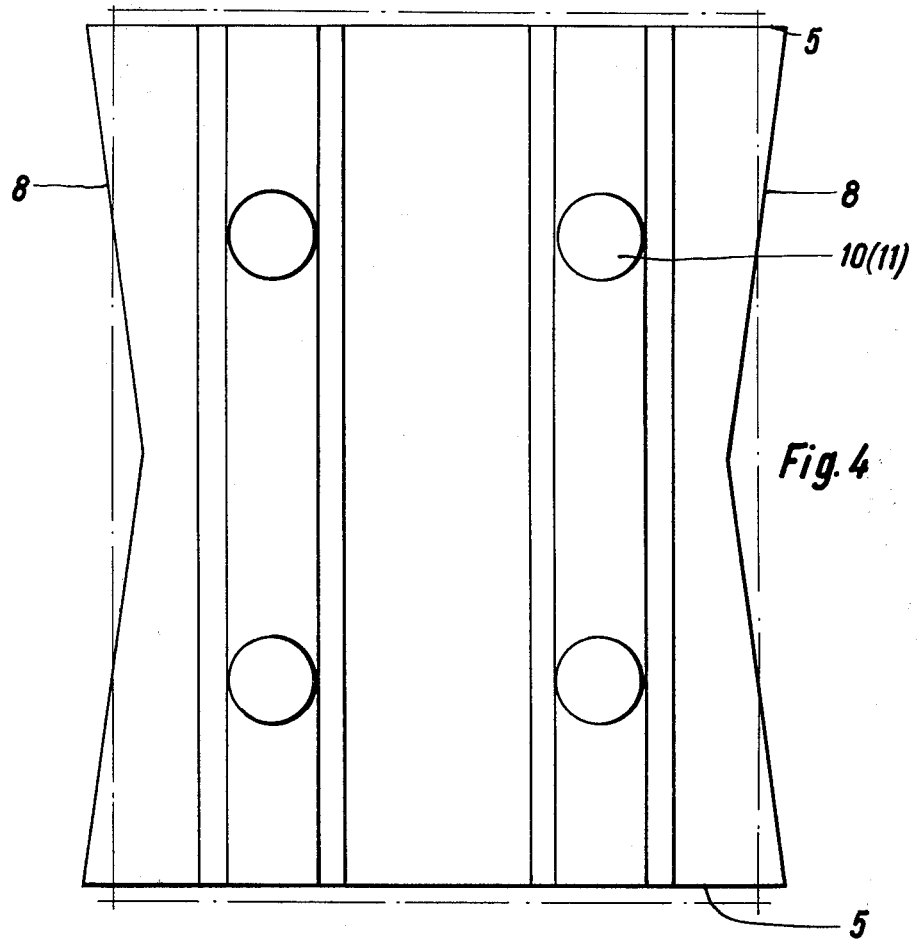
Fig. 4
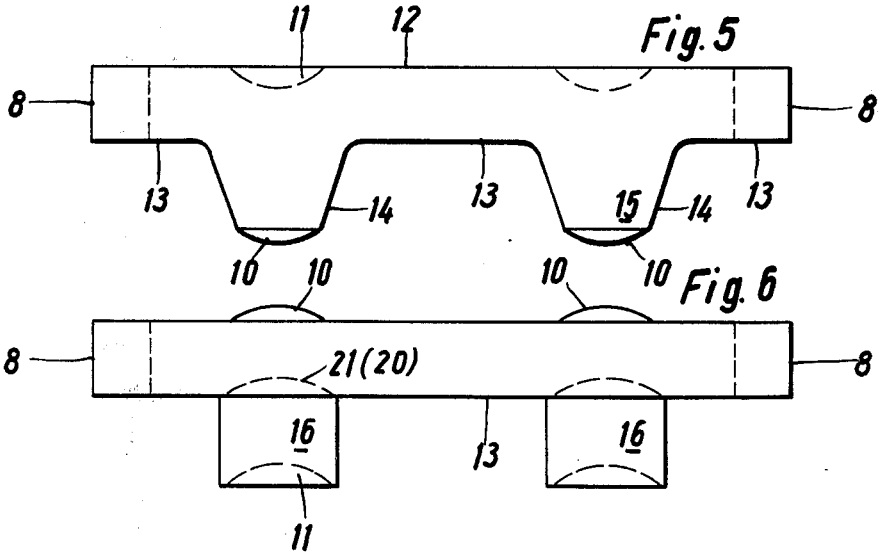
Fig. 5
Fig. 6

BRICK CONSTRUCTION FOR HORIZONTAL REGENERATOR

BACKGROUND OF THE INVENTION

1. Field of the Invention

This invention relates to a brick construction for horizontally disposed regenerators. More particularly, this invention relates to a checker brick construction for a horizontally disposed regenerator which provides for expansion due to forces created within the regenerator and also provides for a high degree of stability by virtue of interlocking the bricks in the horizontal regenerator. This invention is particularly directed to a construction whereby horizontally disposed bricks are engaged with other horizontally disposed bricks and horizontally disposed rows of bricks are engaged with one another by the use of vertical risers or spacers which engage the horizontally disposed bricks.

2. Discussion of the Prior Art

As disclosed in U.S. Pat. No. 2,473,427 it has been known to assemble checker bricks for vertical regenerators by the use of spacer or distance ribs to form a checkerboard network. The bricks are laid in a vertical plane and are arranged with their longitudinal and transverse edges displayed to the bricks of the adjacent plane. The bricks are laid on top of one another with sufficient clearance for thermal expansion.

It has become desirable, however, to provide a stable system for horizontally disposed regenerators which insures satisfactory stability of the checkerboard type brick assembly when expansion within the regenerator is effected. Such a checkerboard type network must be able to adapt to varying constructions and conditions. In addition, it must accommodate the expansion movements caused by very high temperatures within the horizontal regenerator. Additionally, it must cope with large pressure variations which may occur within the horizontal regenerator.

It is an object of this invention, therefore, to provide a checker brick construction for horizontally disposed regenerators which allows for expansion movement to a sufficient extent but simultaneously insures the stability of the individual bricks by interlocking the same, whereby especially the frontmost brick layers do not tend to become removed from the construction after a period of operation.

SUMMARY OF THE INVENTION

The objects of the invention are provided in a horizontally disposed regenerator having a plurality of generally parallel courses of bricks separated by vertical spacers, each course of which runs generally horizontal wherein the bricks have a generally slab-like horizontal surface, and the vertical risers run generally longitudinal of the slab-like surfaces between courses thereof, the slab-like surfaces engage slab-like surfaces of an adjoining horizontally disposed brick, and the vertical spacers engage the slab-like surfaces by a tongue and groove connection.

There are several embodiments of the present invention wherein a rectangular checker brick construction is equipped with several types of tooth-like formations running in the longitudinal direction of the brick for connection in the horizontal direction to the longitudinal sides of adjacent brick by engagement therewith as by a gear engagement. There are also a number of different means by which the slab-like surfaces of horizontally disposed bricks can be connected to other courses by vertical spacers through a tongue and groove connection, employing the spacer ribs to engage the bricks of generally parallel courses.

According to the present invention, tooth-like formations of the longitudinal side of a brick can be formed by its being notched at an obtuse angle for engagement with other horizontally disposed bricks. In another embodiment of the invention, the longitudinal side of a brick is corrugated or shaped sinusoidally to engage surfaces similarly shaped on adjoining horizontal brick. In both of these instances, the horizontally disposed bricks are disposed out of phase with one another so as to insure a relatively good connection at the junction between bricks in the same longitudinal course.

Another means for accomplishing the horizontal engagement of bricks in such a construction is by utilizing rectangular cuts in the center region of the bricks in which the protuberances of an adjacent brick can engage. Other tooth-like formations for the longitudinal sides can be chosen so that the displacement of a brick layer in the direction of flow of a medium through the horizontal regenerator is precluded without impairing the ability of the structure to yield to expansion movements.

In a preferred embodiment of the invention, a tongue and groove connection is made in which a vertical spacer rib or riser is provided with a dome-shaped protuberance at its upper end where it can engage a similarly dome-shaped indent on the lower surface of the brick. Similarly, there can be provided a brick having a slab-like surface having a dome-shaped indent in its upper surface which engages with a vertical spacer having on its terminal lower end a similar contour which fits within the dome-shaped indent of the brick.

Still another embodiment for engagement of parallel running courses of brick involves the use of a brick whose slab-like surface has on its upper surface a dome-shaped riser which engages a vertical riser having a dome-shaped indent on the terminal lower end thereof which fits over the riser on the surface of the brick. The dome-shaped indent is engaged by the vertical riser at the vertical riser's lower end.

Preferably, each brick is provided with at least two tongues and/or grooves for engagement with a vertical riser having the cooperating shape.

The term "dome-shaped" is used herein to express a preferred form for the risers or bricks, i.e., wherein they have a calotte-like shape. Obviously, numerous changes can be made without departing from the invention, it being the essence of the invention to join horizontally disposed bricks running parallel to one another in different horizontal planes by vertical risers by the use of a tongue and groove connection. In using a dome-like tongue and groove arrangement the bricks are fixed with one another while the weight is transferred by the vertical spacers themselves onto the brick row lying therebeneath. Tongue and groove arrangements like truncated cones can also be used to advantage. In a preferred exemplified embodiment, there are employed two vertical spacer ribs having tongue and groove connections for a checker brick. Each checker brick has four tongue and groove connections which are arranged respectively in a quadrant of the rectangular checker brick. This arrangement is particularly suitable for a displaced arrangement where the bricks are respectively displaced from one another by half a brick width. The brick layer is respectively repeated in every fourth plane according to this pattern.

In another embodiment of the invention, vertical spacer ribs are connected by a second tongue and groove connection to the checker brick assembly. This connection can again be provided in the shape of a calotte, a truncated cone or the like in several positions between the checker brick and the vertical spacer rib. Moreover, a circular groove running in the longitudinal direction of the brick can be provided which is engaged by a cylindrical spacer rib. This two-part construction of vertical spacer rib and checker brick offers the advantage that the extrusion levels of the checker brick and the vertical spacer rib can be adapted to varying operating conditions.

The gaps between individual bricks are established knowing in advance the extension of individual bricks and the manufacturing tolerances which should be considered for a given horizontal regenerator.

When installing the checker bricks in accordance with the invention in round regenerators, which are more advantageous statically and economically using high internal pressures, specific flanged bricks such as shown in FIGS. 10 and 11 described below are desirably employed.

BRIEF DESCRIPTION OF DRAWINGS

The present invention can be more readily understood and appreciated when reference is made to the accompanying drawings in which:

FIG. 4 is a top plan view of an embodiment showing a brick of FIG. 3 provided with means for effecting vertical and horizontal connection between horizontal rows of bricks;

FIG. 5 is a front elevation showing an embodiment of the invention whereby the bricks in a horizontal row are connected with the bricks in a row therebeneath by vertical spacers;

FIG. 6 is a view similar to FIG. 5 showing another embodiment of a tongue and groove vertical connection;

DESCRIPTION OF SPECIFIC EMBODIMENTS

Figure 1:
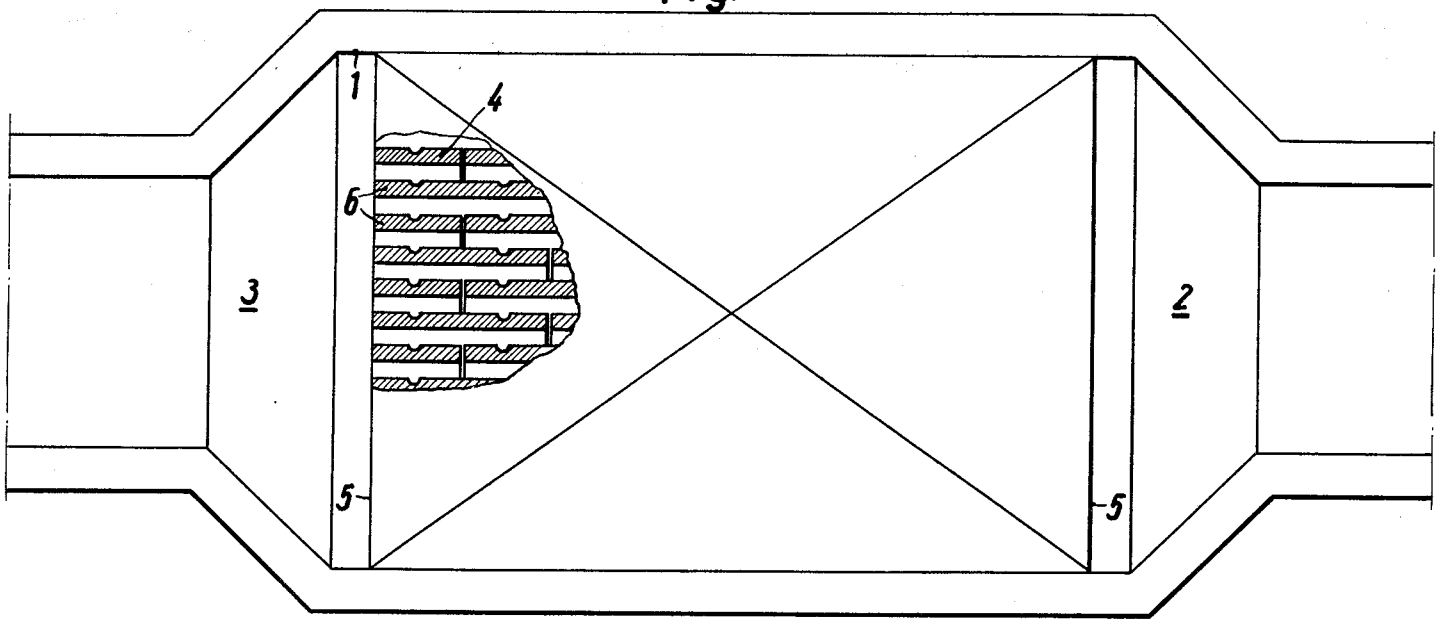
FIG. 1 is a horizontal regenerator partially broken away showing how bricks are installed in a horizontal plane.
Figure 2:
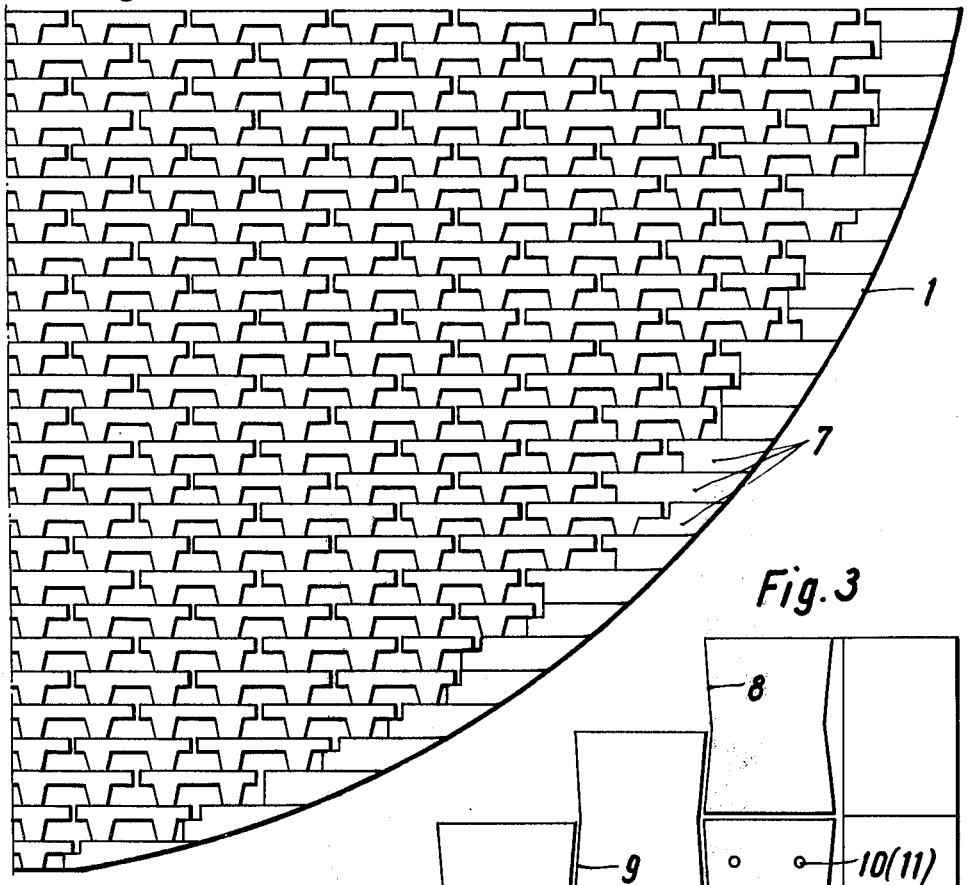
FIG. 2 is a partial cross-section according to FIG. 1.

A horizontally disposed regenerator is shown in FIG. 1 which has a generally cylindrical cross-section having a checker heating chamber 1, an entry cone 2 and an exit cone 3. According to processes involved in the use of such a horizontally disposed regenerator, the cones 2 and 3 are alternately supplied with the heat emitting medium and the heat receiving medium. The temperature can vary between 20° and 1600° C. Within the regenerator there is a checker network formed by a plurality of individual bricks 4. Each of these bricks has a generally slab-like surface.

According to the invention the checker bricks 4 have a longitudinal side 8 which can engage an adjacent checker brick. In the longitudinal direction of the brick there are provided two vertical spacer ribs or bars 14 and 16, which are fixed by a tongue and groove connection 10 and 11 on an adjacent checker brick disposed vertically with respect thereto. The bricks 4 of an individual checker plane are arranged so as to be displaced both vertically and horizontally with respect to one another.

Figure 3:
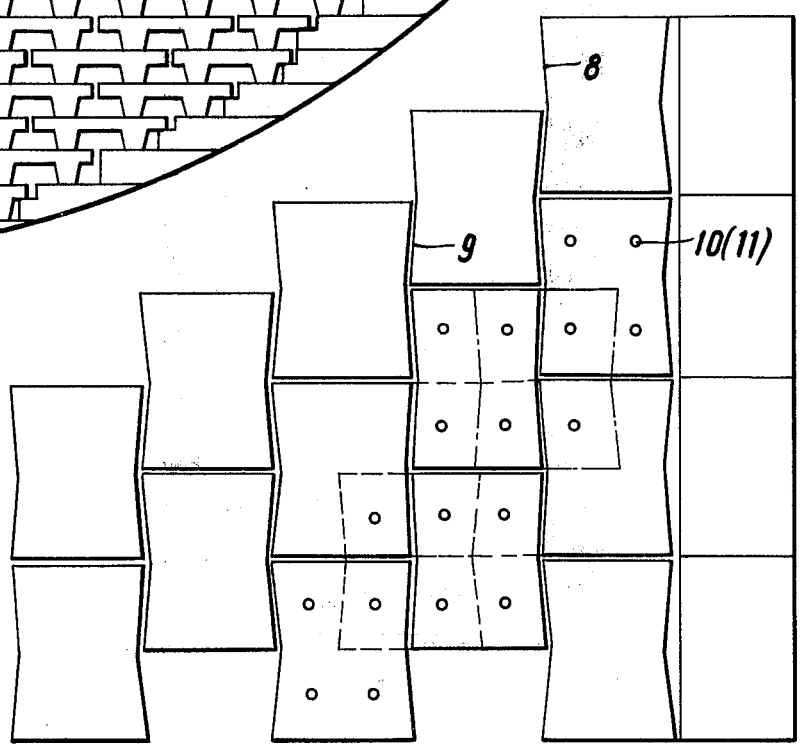
FIG. 3 is a top plan view of a detail of a brick layer wherein the bricks have longitudinal surfaces which are indented to define obtuse angles.
Figure 7:
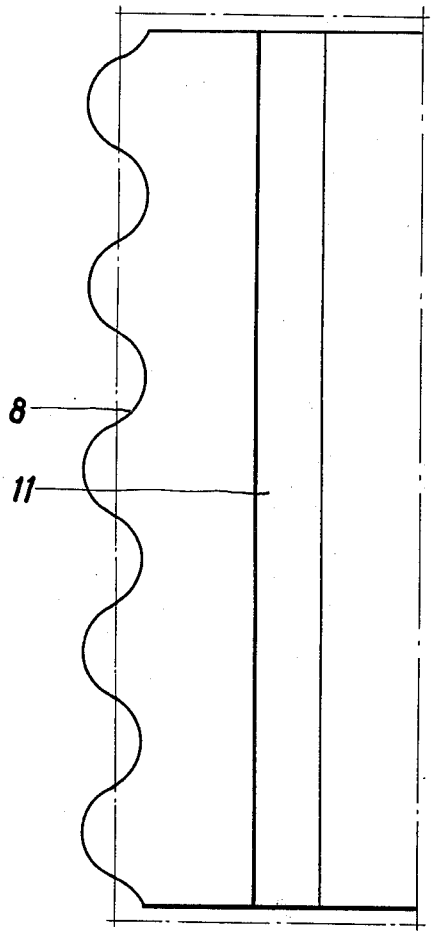
FIG. 7 is a view similar to FIG. 3 showing another embodiment of a brick for effecting horizontal connection between adjacent rows of horizontally running bricks.
Figure 8:
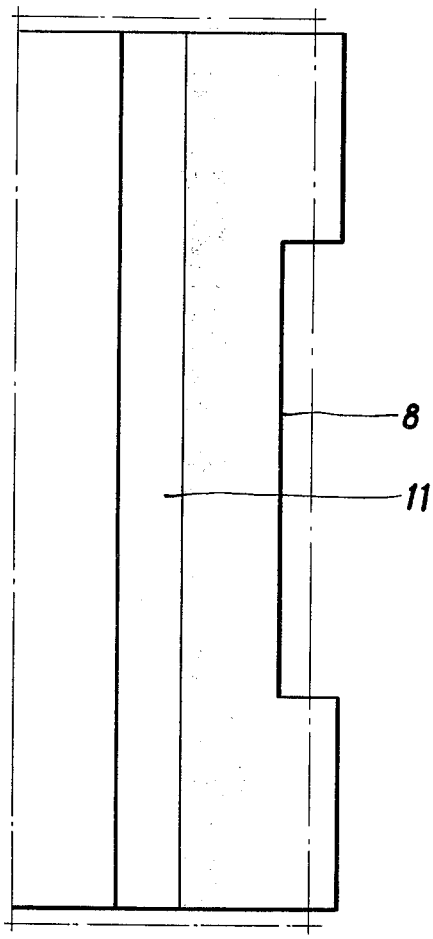
FIG. 8 is a view similar to FIG. 7 showing still a third embodiment of the invention.

As the top plan view of FIG. 3 depicts, one embodiment of the invention lies in the formation of an indent on each longitudinal side of the brick which indent forms an obtuse angle. As shown in FIG. 3 such an obtuse shaped indent can be used for a gear-like engagement with offsetly disposed adjacent bricks. This engagement with neighboring or adjacently disposed bricks occurs in the horizontal plane. The gap 9 is chosen large enough so that the permissible brick tolerance and thermal expansion per brick are accounted for. The tongues 10 and grooves 11 insure satisfactory engagement and connection of individual checker layers with one another as shown in FIG. 3. The same arrangement is again given after four consecutive layers. With the engagement described, there results a good positive connection of bricks with one another which avoids any slipping of foremost checker bricks 6.

The embodiment shown in FIG. 3 of the checker bricks 4 is especially used when the same are set into four quadrants which are respectively fixed by a tongue and groove connection 10 and 11 in the vertical direction. This special tongue and groove construction is shown in FIGS. 4 to 6. The groove 11 is constructed calotte-like and it engages a cup-shaped tongue 10. The arrangement of tongue and groove serves only for fixation while the weight from one horizontal brick to a brick therebeneath is transferred essentially by the vertical spacer ribs 14 and 16 surface 12 of a checker brick 4. By the determination of the extrusion level between the upper side 12 and the under side 13 of the brick 4 and of the extrusion level of the vertical spacer ribs 14 and 16, the ratio of weight to exchange surface and consequently the entire checker network for the horizontal regenerator is determined.

Figure 9:
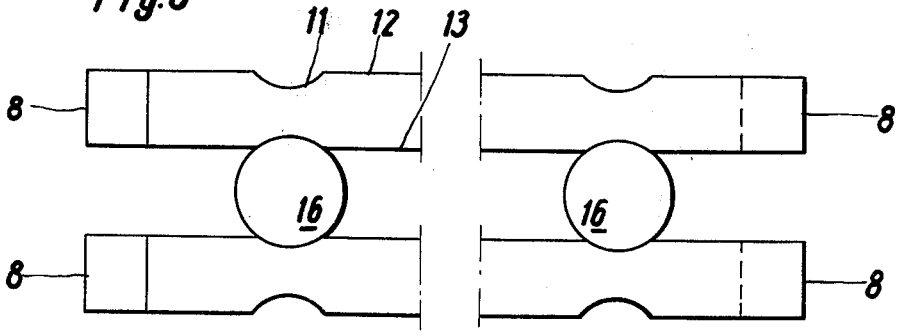
FIG. 9 is a frontal elevation similar to FIGS. 5 and 6 showing another type of a vertical spacer rib.

A particularly effective embodiment of the invention is shown in FIGS. 6 and 9 which is particularly suitable for varying measurements, as with this construction spacer rib 16 is connected by a second tongue and groove connection 20 and 21 with a checker brick 4. The second tongue and groove connection 20 and 21 is again constructed spherically. According to FIG. 9, a cylindrical spacer rib 16 is arranged in a partially circular groove 11 in the checker brick 4. The rectangular construction of the spacer rib 16 is suitable for the transfer of high pressures while the cylindrical shape of spacer rib 16 is expedient for low pressure operations employing high temperatures. The exemplified embodiments of FIGS. 6 and 9 are particularly suitable for the alteration of the extrusion level. Moreover, by a simple storage of bricks and vertical ribs of varying heights, there can be constructed horizontal regenerators having widely varied weight to exchange ratios.

Moreover, such a construction employing cylindrical ribs is not impaired when bricks having uneven surfaces are employed.

Figure 10:
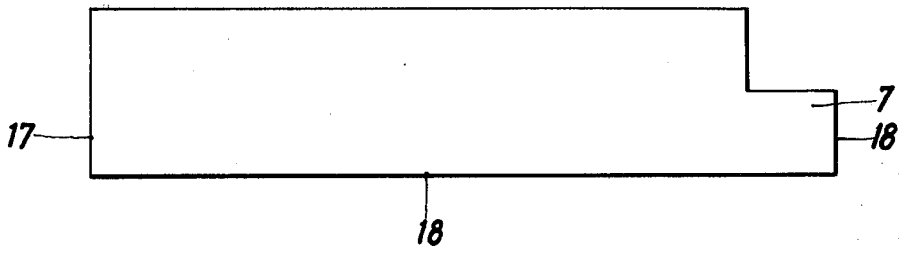
FIG. 10 is a view showing flanged bricks in frontal elevation for use in the construction of round regenerators.
Figure 11:
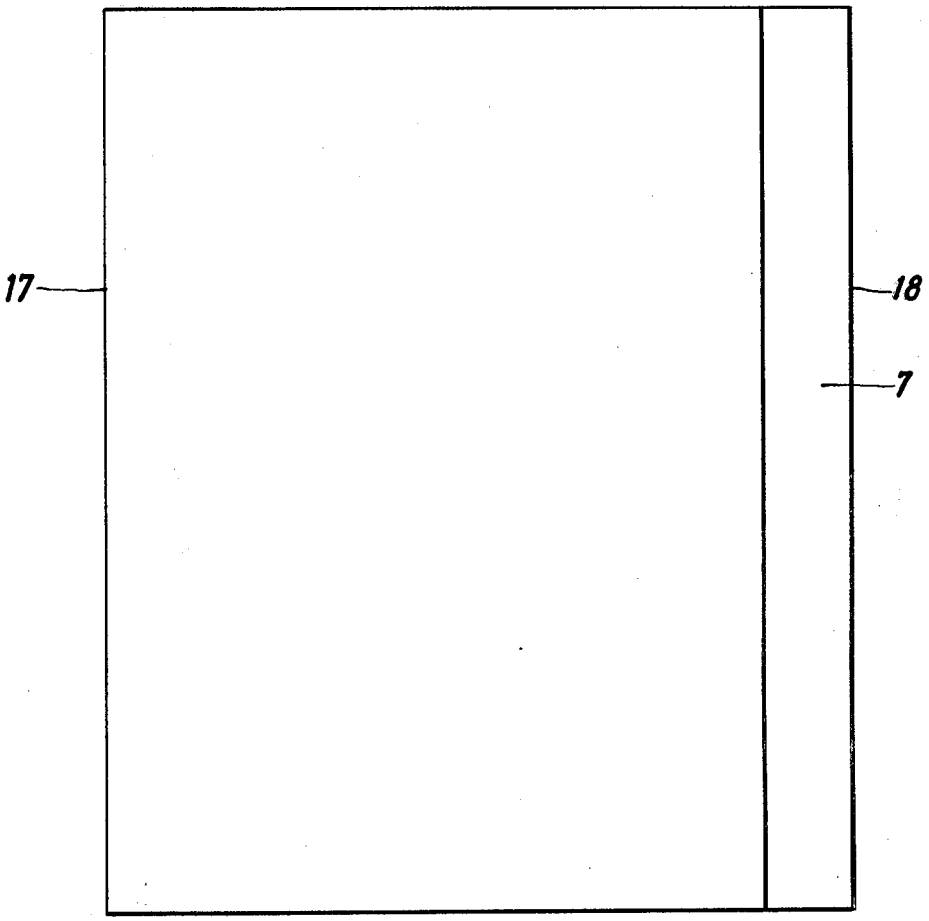
FIG. 11 is a top plan view showing flanged bricks according to FIG. 10.

In FIGS. 10 and 11 there are shown bricks having flanges which are useful in the construction of round regenerators. The height of the longitudinal side 17 is determined by the height of the longitudinal side 8 of the checker brick 4 in addition to the height of the vertical spacer ribs 14 and 16. The height of the longitudinal side 18 and of the lug 17 is determined by the height of the vertical spacer rib. The length of side 19 is adapted so as to provide the desired ratios and is selected at the construction site. The flanged brick enables a satisfactory transfer from the edge of the receptacle whereby the static conditions, i.e., power transmission of the shearing forces, are completely fulfilled by the masonry construction.

What is claimed is:

1. In a horizontally disposed regenerator having a plurality of generally parallel courses of bricks separated by vertical spacers, each course of which runs generally horizontal, the improvement wherein the bricks have a generally slab-like horizontal surface, wherein the longitudinal sides of said slab-like surface of said horizontal brick are provided with a tooth-like formation engaging in an offset manner the tooth-like formation of an adjoining horizontal brick in the same horizontal plane whereby said horizontal bricks are offset from one horizontal row to another horizontal row as the adjoining bricks are engaging one another in offset position the vertical spacers run generally longitudinal of said slab-like surfaces between courses thereof, said vertical spacers engaging the slab-like surfaces by a tongue and groove connection.

2. A horizontally disposed regenerator according to claim 1 wherein the tooth-like formations are formed by having the longitudinal sides of the slab-like surfaces notched inwardly to define an obtuse angle.

3. A horizontally disposed regenerator according to claim 1 wherein the slab-like surface of a brick has a dome-shaped indent in its upper surface and said vertical spacers have terminal lower ends whose contour fits within said indent.

4. A horizontally disposed regenerator according to claim 3 wherein there are at least two of said vertical spacers connected to each brick.

5. A horizontally disposed regenerator according to claim 1 wherein said slab-like surface of a brick has on its upper surface a dome-shaped riser, said vertical spacers having a dome-shaped indent at their terminal lower end which fits over said riser and said dome-shaped indent is engaged by said vertical riser at its lower end.

6. A horizontally disposed regenerator according to claim 5 wherein there are at least two of said vertical spacers connected to each brick.

7. A horizontally disposed regenerator according to claim 5 wherein said slab-like surface additionally has on its lower surface a dome-shaped insert which is engaged by a vertical spacer having on its upper surface a correspondingly dome-shaped protrusion and on its lower surface a dome-shaped indent.

8. A horizontally disposed regenerator according to claim 1 wherein said vertical riser is unitary and integral with said brick.

9. A horizontally disposed regenerator according to claim 1 wherein said vertical risers and said slab-like surfaces are separate elements detachable from one another.

10. A horizontally disposed regenerator according to claim 1 wherein the tooth-like formations are formed by having the longitudinal sides of said slab-like surfaces corrugated.

11. A horizontally disposed regenerator according to claim 1 wherein the tooth-like formations are formed by having the longitudinal sides of said slab-like surfaces notched inwardly to form a generally rectangular recess which is engaged by a pair of teeth of adjoining horizontally disposed bricks.

* * * * *

UNITED STATES PATENT AND TRADEMARK OFFICE

CERTIFICATE OF CORRECTION

PATENT NO. : 4,004,633

DATED : January 25, 1977

INVENTOR(S) : Wolfgang Cronert

It is certified that error appears in the above–identified patent and that said Letters Patent are hereby corrected as shown below:

The priority document number should be changed from "441153" to --73 44115 --.

Signed and Sealed this Third Day of May 1977

[SEAL]

*Attest:*

RUTH C. MASON
*Attesting Officer*

C. MARSHALL DANN
*Commissioner of Patents and Trademarks*